US007621245B2

(12) United States Patent
Lechner

(10) Patent No.: US 7,621,245 B2
(45) Date of Patent: Nov. 24, 2009

(54) CAMSHAFT

(75) Inventor: Martin Lechner, Lindlar/Frielingsdorf (DE)

(73) Assignee: Mahle International GmbH, Stuttgart (DE)

( * ) Notice: Subject to any disclaimer, the term of this patent is extended or adjusted under 35 U.S.C. 154(b) by 92 days.

(21) Appl. No.: 11/649,918

(22) Filed: Jan. 4, 2007

(65) Prior Publication Data

US 2007/0151530 A1 Jul. 5, 2007

(30) Foreign Application Priority Data

Jan. 5, 2006 (DE) ..... 10 2006 000 846

(51) Int. Cl.
*F01L 1/04* (2006.01)

(52) U.S. Cl. ..... 123/90.6; 123/90.31; 123/90.44; 29/888.1; 74/567

(58) Field of Classification Search ..... 123/90.27, 123/90.31, 90.6, 90.16, 90.44; 74/567; 29/888.1
See application file for complete search history.

(56) References Cited

U.S. PATENT DOCUMENTS 4,660,269 A 4/1987 Suzuki
5,627,464 A * 5/1997 Shinjo et al. ..... 324/207.2
7,314,031 B2 * 1/2008 Le Troadec et al. ..... 123/90.6

FOREIGN PATENT DOCUMENTS

| | | | |
|---|---|---|---|
| DE | 196 40 872 | A1 | 4/1998 |
| DE | 197 03 821 | A1 | 8/1998 |
| DE | 299 18 298 | U1 | 2/2000 |
| DE | 100 49 454 | A1 | 4/2002 |
| EP | 1 464 793 | A1 | 10/2004 |
| JP | 58-98608 | | 11/1983 |

OTHER PUBLICATIONS

European Search Report dated Mar. 5, 2009.

* cited by examiner

*Primary Examiner*—Ching Chang
(74) *Attorney, Agent, or Firm*—Collard & Roe, P.C.

(57) ABSTRACT

The present invention relates to a camshaft (1) for more preferably motor vehicle engines with a termination element (2) arranged with an axial end side in or on the camshaft (1) and permanently joined to the latter which closes off the camshaft (1) in axial direction and which is designed as drive element for an auxiliary unit on the output side. Here it is essential to the invention that the termination element (2) is formed as a formed sheet metal part.

10 Claims, 6 Drawing Sheets

CAMSHAFT

CROSS REFERENCE TO RELATED APPLICATIONS

Figure 1A:
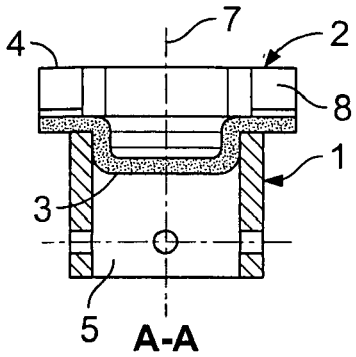
Figure 1B:
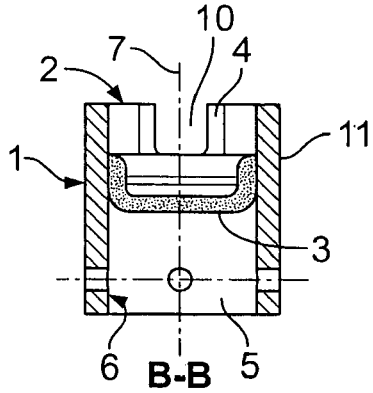
Figure 1C:
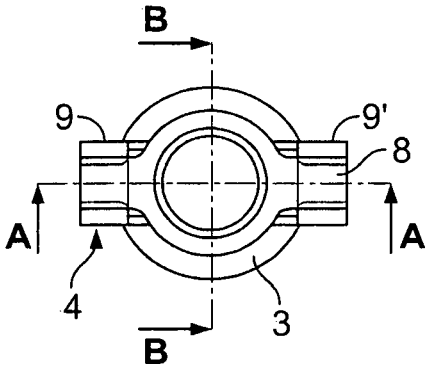

Applicant claims priority under 35 U.S.C. 119 of German Application No. DE 10 2006 000 846.4 filed Jan. 5, 2006.

The invention relates to a camshaft for more preferably motor vehicle engines with a termination element arranged on the axial end side in/on the camshaft and permanently connected with the camshaft in accordance with the preamble of claim 1.

Such termination elements are generally known and serve as axial termination of the camshaft as well as drive element for an auxiliary unit arranged on the output side. With the camshafts known today termination elements of solid material are used which are permanently joined with an axial end side of the camshaft and which are designed so that they satisfied in the long term the existing requirements in terms of a torque to be transmitted. However, disadvantageous here is that such termination elements of solid material on the one hand are heavy and as a result increase a total weight of the camshaft respectively the internal combustion engine and thus the motor vehicle and on the other hand are elaborate and therefore expensive to manufacture.

The invention deals with the problem of improving a camshaft of the type mentioned at the outset in that on the whole a weight-reduced camshaft can be created which is additionally more cost-effective to manufacture.

According to the invention this problem is solved by the object of the independent claim 1.

The invention is based on the general thought to form a termination element responsible for transmitting the drive moment to an auxiliary unit, which is arranged axially end-sided in or on the camshaft and permanently joined with the latter as a formed sheet metal part. Such a sheet metal part has a clearly lower weight compared with a termination element manufactured of solid material, which has a positive effect on an energy balance of the motor vehicle equipped with the camshaft according to the invention. In addition, the manufacture of a termination element designed as a formed sheet metal part is clearly easier and more cost-effective than a comparable termination element of solid material. Of particular advantage is also that such a termination element can be manufactured in almost any shape without elaborate changes to the production machines being required to do so. A simple replacement of ram and die in the relevant forming tool for instance is sufficient. The formed sheet metal part designed as termination element transmits the applied torque that occurs from the axial end area of the camshaft to the auxiliary unit such that the torque that occurs can be transmitted over the entire service life of the camshaft or the termination element without problems.

Practically, the termination element is punched, drawn and/or hardened. Modern punching methods allow manufacture of the termination element according to the invention with low unit costs and high precision at the same time. High manufacturing quality with low unit costs at the same time are decisive competitive advantages today, which can consequently be realized through the termination element according to the invention. Hardening of the termination element increases the wear resistance of the latter and extends its service life.

According to a further advantageous embodiment of the solution according to the invention the termination element is permanently bonded, pressed, welded or screwed by way of a circumferential thread formed on a first coupling area, which interacts with an opposite thread on the camshaft via its first coupling area. The mentioned connection variants already prove the manifold possibilities of a connection between the termination element and the camshaft, while, depending on quality requirements or also matched to other peripheral conditions, the connection can be freely selected. This offers a high level of flexibility in terms of the use of the termination element according to the invention. More preferably the connection by way of a screw connection additionally allows easy exchange and replacement of the termination element during repair.

Practically, the second coupling area of the termination element is designed as a bearing shell or slot running transversely to the camshaft axis and open to the axial end of the camshaft and in this way increases a support surface of a driver of the auxiliary unit arranged on the output side which is complimentarily co-formed and engages in the bearing shell or the slot. Here, the second coupling area formed as bearing shell or slot preferably engages in recesses in the camshaft cylindrical surface which are open towards the axial end of the camshaft. The bearing shell open towards the axial end of the camshaft or the slot can be shaped in any way whatsoever, so that more preferably a longitudinal extension of the bearing shell running transversely to the camshaft axis can be adapted to respective requirements. The engaging of the bearing shell in recesses in the camshaft cylindrical surface which are open towards the axial end of the camshaft guarantees a rotationally fixed connection between the termination element and the camshaft, wherein the camshaft cylindrical surface is lined and reinforced through the arms of the termination element engaging in the recesses and additionally protected against excessive wear as a result.

Advantageous exemplary embodiments still explained below are schematically shown in the drawings.

It shows, each schematically

FIG. 1*a-d* sectional representations and views of a termination element according to the invention, FIG. 2*a-d* representations as in FIG. 1*a-d*, however with another embodiment of a second coupling area, FIG. 3*a-d* a representation as in FIG. 1*a-d*, however with a further embodiment, FIG. 4*a-d* sectional representations and views of a termination element which is completely arranged within a camshaft, FIG. 5*a-d* sectional representations and views of a termination element which comprises the camshaft on the axial end side, FIG. 6*a-d* sectional representations and views of a termination element, wherein a second coupling area is located radially outside the camshaft, FIG. 7*a-d* sectional representations and views of a termination element which protrudes over the camshaft on the axial end side, FIG. 8*a-d* a version of the termination element with radially continuous second coupling area and a web-type first coupling area, FIG. 9*a-d* a termination element where the second coupling area has a belly-type bulge, FIG. 10*a-d* a termination element where the first coupling area is formed through two webs bent out of the second coupling area.

According to FIG. 1*a* an axial end area of a camshaft 1 is shown on which a termination element 2 permanently connected with the camshaft 1 is arranged. The termination element 2 terminates the camshaft 1 in axial direction and is simultaneously designed as drive element for an auxiliary unit arranged on the output side and not shown. According to the invention the termination element 2 is designed as a formed sheet metal part while it can be for instance punched, drawn and/or hardened.

The termination element 2 according to FIG. 1*a-d* has a first coupling area 3 by way of which it is permanently connected with the camshaft 1 and a second coupling area 4, by way of which it can be drive-connected with the auxiliary unit on the output side. With its first coupling area 3 the termination element 2 enters a circular-cylindrical cavity 5 of the camshaft 1 according to the sectional representations in FIGS. 1*a* and *b* and is at least partly in contact with parts of the first coupling area 3 on an inner cylindrical surface 6 of the camshaft 1. Here, an attachment of the termination element 2 by way of its first coupling area 3 with the camshaft 1 by way of bonding, pressing or welding can be realized, while it is also conceivable that a circumferential thread, for example an external thread, is provided on the first coupling area 3 which interacts with a counter thread, for example an internal thread, on the inner cylindrical surface 6 of the camshaft 1, in this way realizing the attachment of the termination element 2 on the camshaft 1 by way of a screw connection. Such a screw connection can facilitate exchange or replacement of the termination element 2 according to the invention. For long operating or service lives the termination element 2 formed as a formed sheet metal part is preferably hardened.

Figure 1D:
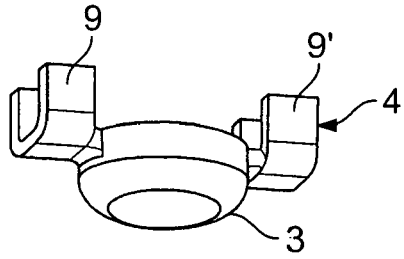

The second coupling area 4 of the termination element 2 according to FIG. 1*a-d* is designed as a bearing shell 8 which runs transversely to the camshaft axis 7 and is open towards the axial end of the camshaft 1, which for example has a slot-shaped design, and as a result enlarges a support surface of a driver of the auxiliary unit arranged on the output side which is not shown, which is designed complimentarily to this and engages in the bearing shell 8. According to FIG. 1*a* the bearing shell 8 or the slot runs in the figure plane whereas according to FIG. 1*b* it runs vertically to the figure plane. The second coupling area 4 can have different longitudinal extensions running transversely to the camshaft axis 7 while it is conceivable that as shown in FIG. 1*d* the second coupling area 4 is formed of two coupling sections 9 and 9', which preferably are located radially outside the outer diameter of the camshaft 1. It is obviously also conceivable that the two coupling sections 9 and 9' adjoin each other and as a result jointly form the second coupling area 4, starting from the camshaft axis 7 radially outward to the inner diameter of the camshaft 1 at the longest. A second coupling area 4, which, starting from the camshaft axis 7, extends radially outward to beyond the outer diameter of the camshaft 1, is to be also enclosed by the invention. Such a second coupling area 4 for example would be realized in that the two coupling sections 9 and 9' each extend to the camshaft axis 7 radially inward according to FIG. 2*d* where they contact each other.

To ensure a reliable torque transmission from the camshaft 1 via the termination element 2 to the auxiliary unit arranged on the output side, the second coupling area 4 designed as bearing shell 8 or as slot engages in recesses 10 in the camshaft cylindrical surface 11 which are open towards the axial end of the camshaft 1. Here, the two coupling sections 9 and 9' are designed complimentarily to the recesses 10 in the camshaft cylindrical surface 11 so that a positive connection is created. As a result, the termination element 2 is connected with the camshaft 1 in a rotationally fixed manner regardless of the selected type of attachment of the termination element 2 on the camshaft 1.

As is evident from FIGS. 1*a* and *b* the termination element 2 tightly terminates the camshaft 1 on the axial end side, which means the first coupling area 3 non-positively and tightly contacts the inner cylindrical surface 6 of the camshaft 1.

Figure 2A:
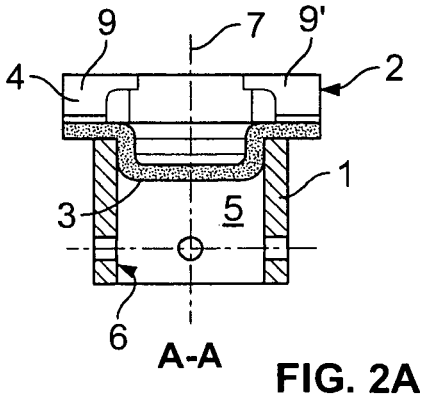
Figure 2B:
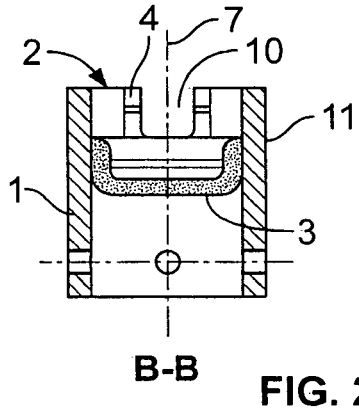
Figure 2C:
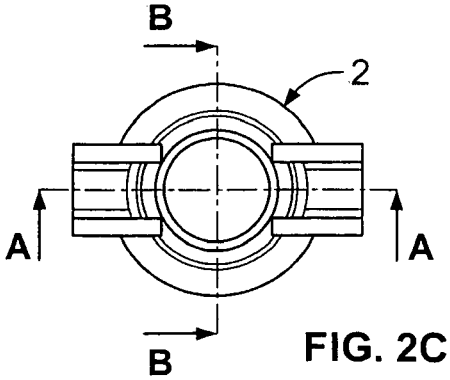
Figure 2D:
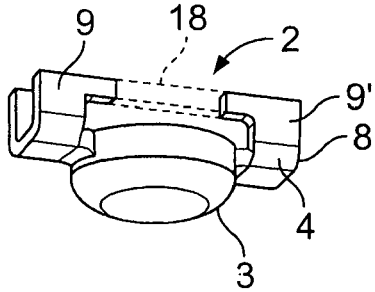
Figure 3A:
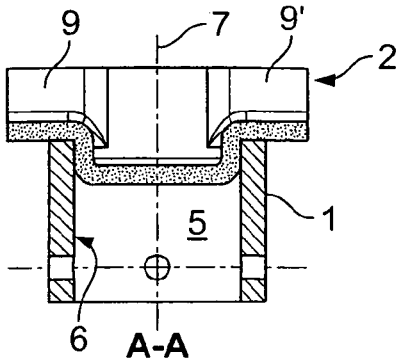
Figure 3B:
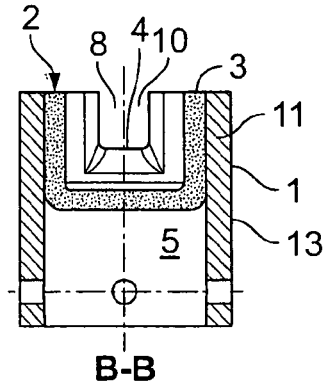
Figure 3C:
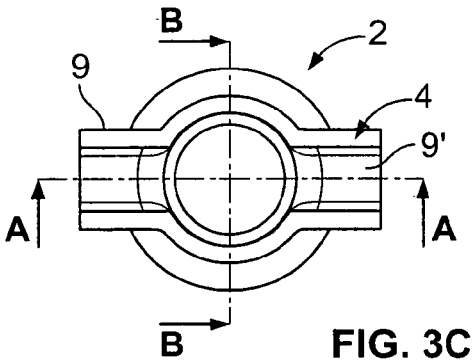
Figure 3D:
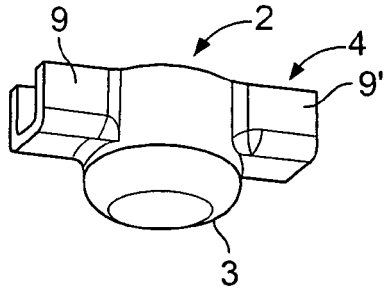
Figure 4A:
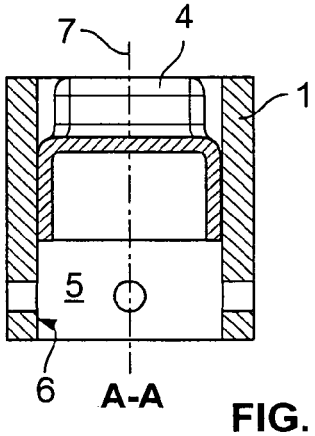
Figure 4B:
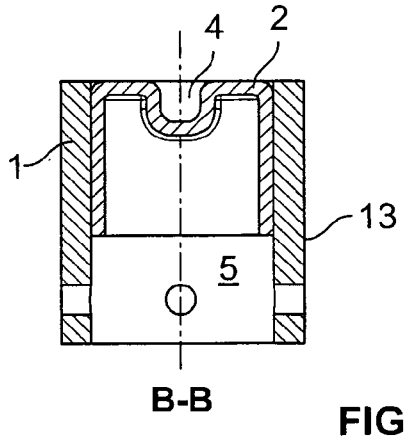
Figure 4C:
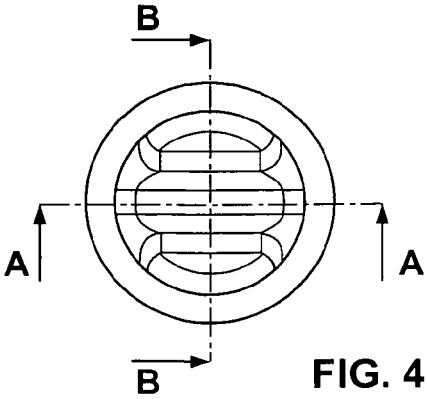
Figure 4D:
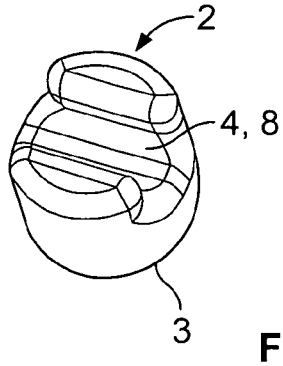

In each of FIG. 2*a*-2*d* a termination element 2 is shown which has a similar design as the termination element 2 according to the FIG. 1*a*-1*d*, while the two coupling sections 9 and 9' can be radially extended inwards. Here it is conceivable that the two coupling sections 9 and 9' according to FIG. 2*d* are radially extended to the inside so far that they contact each other as suggested by the interrupted drawn line. At the same time the two coupling sections 9 and 9' are connected with each other by way of connecting webs 18. A second coupling area 4 extended in this way increases the support surface for a driver engaging in the bearing shell 8.

FIG. 3*a*-3*d* show a version of a termination element 2, wherein in comparison with FIGS. 1 and 2 the first coupling area 3 is expanded in the direction of the second coupling area 4 so that it creates a connection between the two coupling sections 9 and 9'. As a result, in contrast with FIGS. 1 and 2, a particularly sturdy second coupling area 4 is created. In addition, the first coupling area 3 according to FIG. 3*b* reaches clearly further into the cylindrical inner cavity 5 of the camshaft 1, so that a particularly good connection between the termination element 2 and the camshaft 1 is achieved here.

With the embodiment of the termination element 2 according to the FIG. 4*a*-4*d* it is noticeable that the termination element 2 is entirely arranged in the inner cavity 5 of the camshaft 1. At the same time, the second coupling area 4 extends starting from the camshaft axis 7 radially outward and ends before reaching the inner diameter of the camshaft 1. Recesses 10 in the camshaft cylindrical surface 11 are not provided in this case.

Figure 5A:
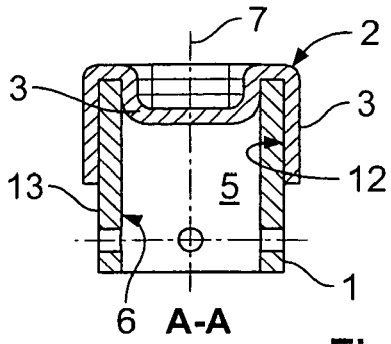
Figure 5B:
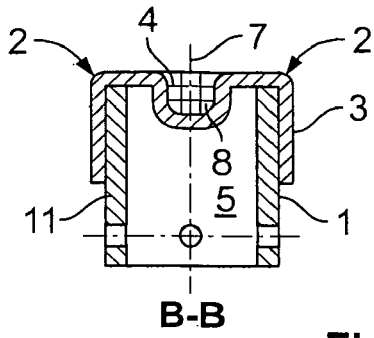
Figure 5C:
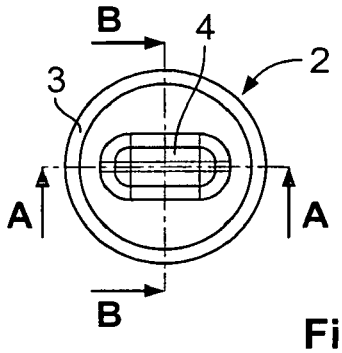
Figure 5D:
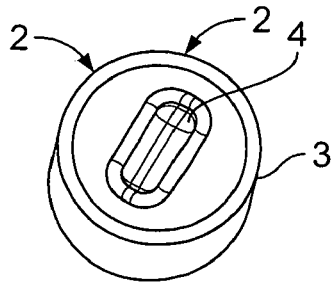
Figure 6A:
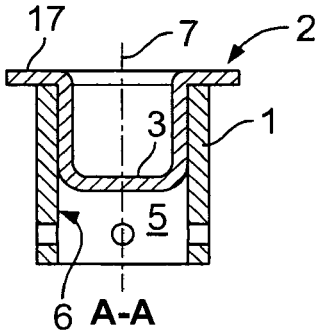
Figure 6B:
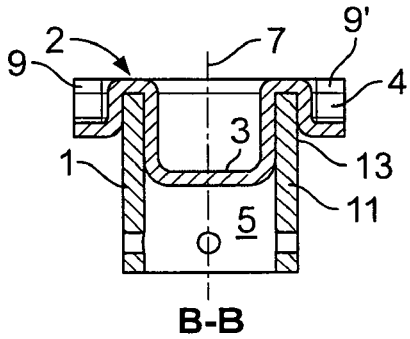
Figure 6C:
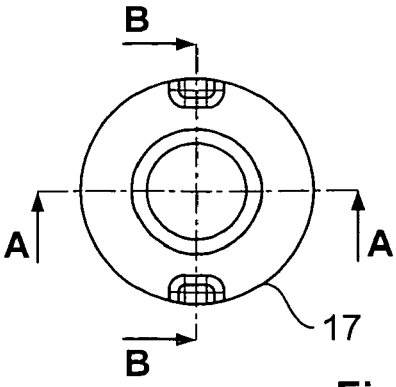
Figure 6D:
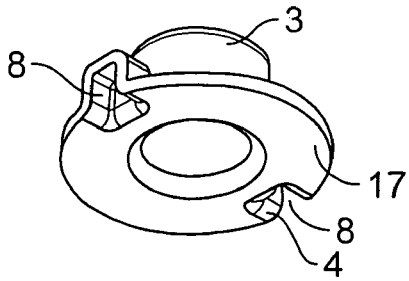

According to FIG. 5*a*-5*d* a termination element 2 is shown which with its first coupling area 3 embraces the camshaft 1 on the axial end side so that an inner cylindrical surface 12 (compare FIG. 5*a*) of the first coupling area 3 of the termination element 2 non-positively contacts an outer cylindrical surface 13 of the camshaft 1. Similar to FIG. 4*a*-4*d* there are no recesses 10 provided in the camshaft cylindrical surface 11 with this embodiment, so that here, too, the second coupling area 4 is located radially within the inner diameter of the camshaft 1. As is shown in FIG. 5*a*, the first coupling area 3 of the termination element 2 does not only embrace the camshaft 1 on the axial end side but additionally rests against the inner cylindrical surface 6 of the camshaft 1, as a result of which a positive and tight connection between the termination element 2 and the camshaft 1 is achieved. In contrast with FIG. 1-3 the torque transmission with the termination elements 2 according to FIGS. 4 and 5 takes place via the non-positive connection between camshaft 1 and termination element 2 and not through a positive connection of coupling sections 9 and 9' of the termination element 2 engaging in recesses 10 on the camshaft 1.

FIG. 6*a* to 6*d* each show a version of the termination element 2 according to the invention where the first coupling area 3 is also formed as in FIG. 5*a* to 5*d* so that on the one hand it rests against the inner cylindrical surface 6 of the camshaft 1 and simultaneously embraces the camshaft 1 on the axial inside, so that the inner cylindrical surface 12 of the termination element 2 positively rests against the outer cylindrical surface 13 of the camshaft 1. At the same time, the second coupling area 4 is divided into two coupling sections 9 and 9' which, starting from the outer diameter of the camshaft 1, extend radially outward. Here, similar to FIGS. 4 and 5, no recesses 10 are provided in the camshaft cylindrical surface 11. According to FIG. 6*a* to 6*d* the termination element 2 additionally has a ring-shaped collar 17 which protrudes radially outward beyond the outer diameter of the camshaft 1. At the same time, the termination element 2 in its embodiment according to FIG. 6*a* to 6*d* adjoins the axial end of the camshaft 1 so that the termination element 2 is not flush with the camshaft 1.

Figure 7A:
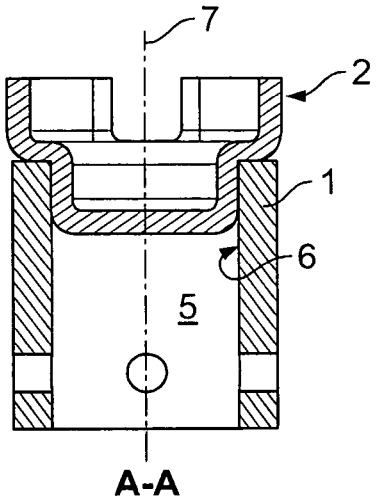
Figure 7B:
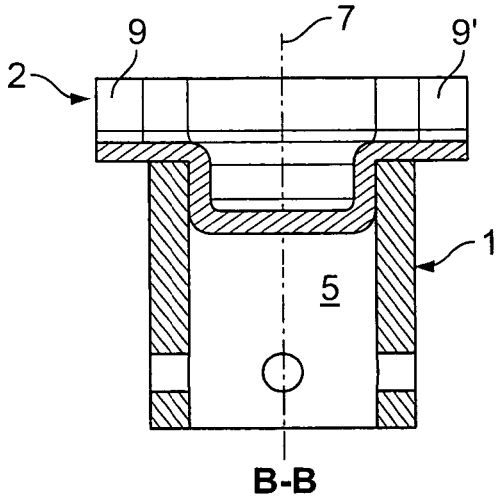
Figure 7C:
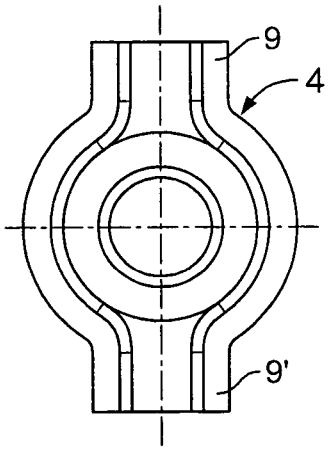
Figure 7D:
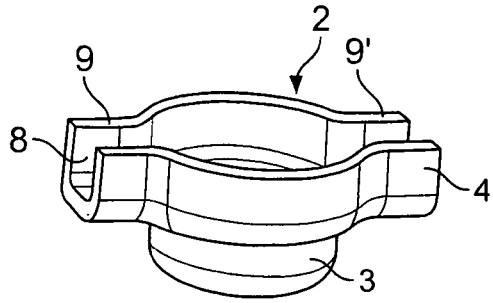
Figure 8A:
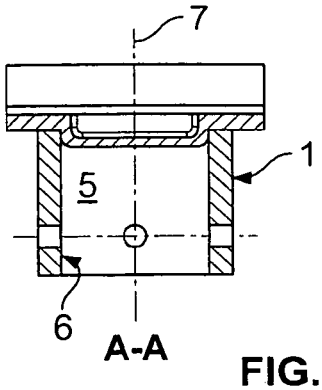
Figure 8B:
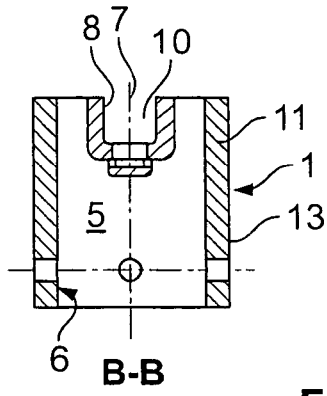
Figure 8C:
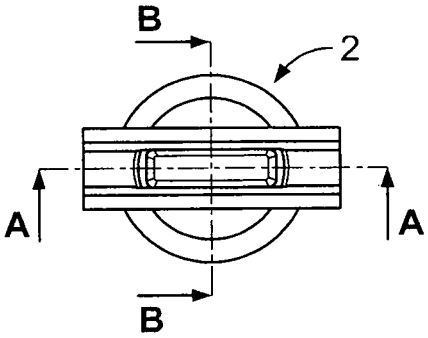
Figure 8D:
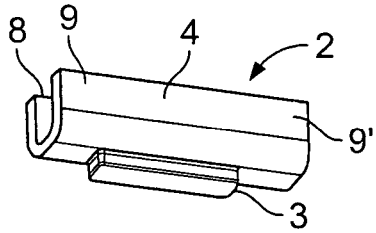
Figure 9A:
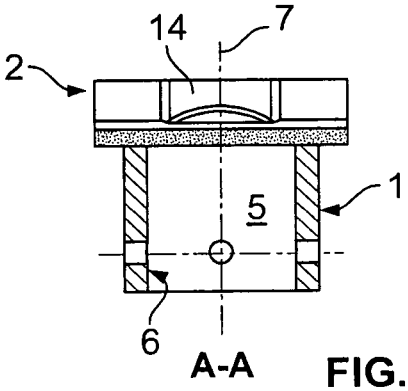
Figure 9B:
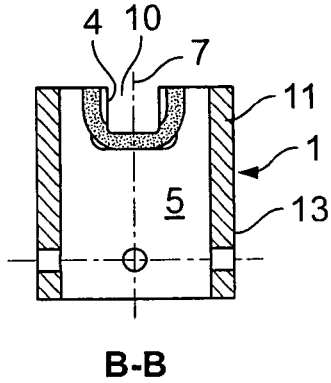
Figure 9C:
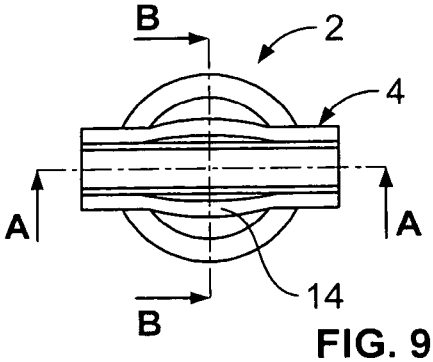
Figure 9D:
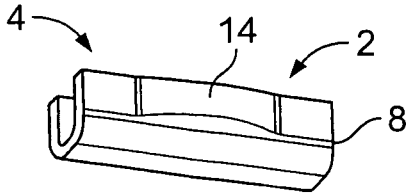
Figure 10A:
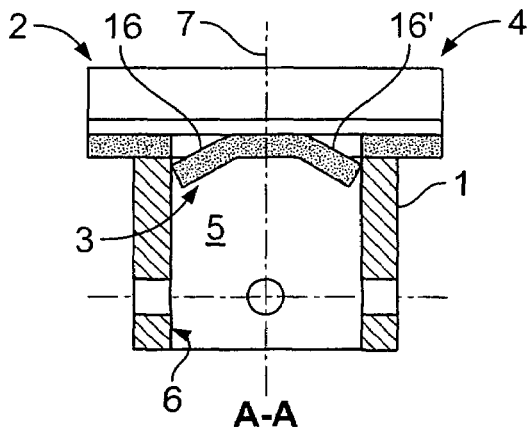
Figure 10B:
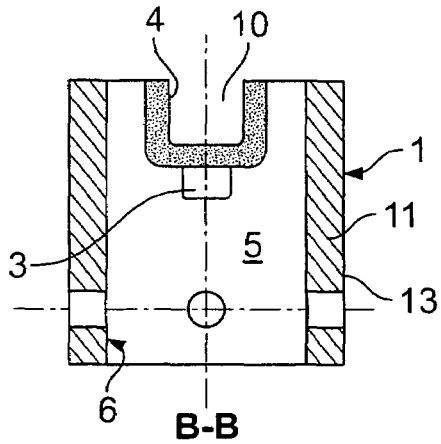
Figure 10C:
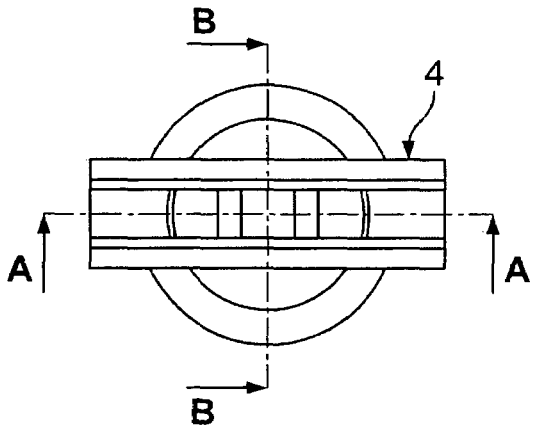
Figure 10D:
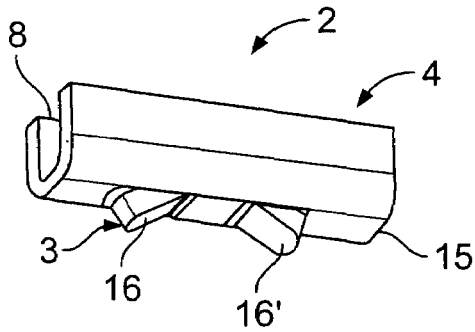

In contrast with this, with a version of the termination element 2 as represented in FIG. 7*a*-7*d* it is provided that the termination element 2 protrudes over the camshaft 1 on the axial end side. At the same time, the second coupling area 4 does not engage in recesses 10 in the camshaft cylindrical surface either and is additionally arranged in axial direction following the end of the camshaft 1. As is shown in FIGS. 7*c* and 7*d* the second coupling area 4 also has two coupling sections 9 and 9' which expand radially inward starting from the inner diameter of the camshaft 1 so that the driver of a downstream auxiliary unit is only subjected to torque transmission by way of the two coupling sections 9 and 9', which are located radially outside the inner diameter of the camshaft 1.

According to FIG. 8*a*-8*d* a termination element 2 is shown which has a continuous second coupling area 4 which extends radially from the camshaft axis 7 to beyond the outer diameter of the camshaft 1. The first coupling area 3 at the same time is formed web-like so that the termination element 2 according to FIG. 8 does not tightly seal the camshaft 1 on the axial end side. A rotationally fixed connection between the termination element 2 and the camshaft 1 is achieved through engagement on both sides of the second coupling area 4 in corresponding recesses 10 in the camshaft cylindrical surface 11.

With the termination element 2 according to FIG. 9*a*-9*d* the second coupling area 4 has a belly-type bulge in the area which is located radially within the inner diameter of the camshaft 1 as a result of which a displacement protection in transverse direction relative to the camshaft axis 7 is provided. At the same time, no additional first coupling area 3 on the termination element 2 is provided with the termination element 2 according to FIG. 9*a*-9*d*, so that a connection between the termination element 2 and the camshaft 1 is achieved merely through engagement of the second coupling area 4 in corresponding recesses 10 on the camshaft cylindrical surface 11 and the belly-like bulge 14. Similar to FIG. 8*a* to 8*d* the termination element 2 according to FIG. 9*a*-9*d* does not tightly seal the camshaft 1 on the axial end side either.

Finally a termination element 2 according to the FIG. 10*a*-10*d* has a second coupling area 4 radially extending to beyond the outer diameter of the camshaft 1 which is formed channel-like and which engages in corresponding recesses 10 on the camshaft cylindrical surface 11. For improved connection of the termination element 2 with the camshaft 1 two webs 16 and 16' are punched and shaped from a floor area 15 of the second coupling area 4 which, according to FIG. 10*a*, support themselves on the inner cylindrical surface 6 of the camshaft 1. The two webs 16 and 16' thus form the first coupling area 3. Similar to FIGS. 8 and 9 the termination element 2 according to FIG. 10 terminates flush with an axial end of the camshaft 1 so that merely the termination element 2 according to FIG. 7 protrudes beyond an axial end of the camshaft 1.

With all versions of the termination element 2 according to FIG. 1 to 10 the termination element 2 can be additionally formed as assembly aid and/or serve as such and as a result, for example, facilitate accurate angle of rotation assembly of the camshaft 1 and/or the auxiliary unit on the output side.

At the same time all characteristics shown in the description and in the following claims can be essential to the invention both individually as well as in any form jointly.

The invention claimed is:

1. A camshaft (1) for motor vehicle engines, with a termination element (2) arranged in or on the camshaft (1) at an axial end side and permanently connected with the camshaft (1) which closes off the camshaft (1) in axial direction and which is formed as a drive element for an auxiliary unit on an output side, wherein, said termination element (2) is formed as a formed sheet metal part, said termination element (2) has a first coupling area (3) by way of which it is permanently connected with the camshaft (1) and a second coupling area (4), by way of which it can be drive-connected with an auxiliary unit on the output side, said second coupling area (4) of the termination element (2) is formed as an open bearing shell (8) or slot running transversely to the camshaft axis (7) and is open towards the axial end of the camshaft (1), and as a result has a large support surface for a driver of the auxiliary unit arranged on the output side formed complimentarily to this driver and engaging in the bearing shell (8) or the slot.

2. The camshaft according to claim 1, wherein, said termination element (2) is punched, drawn and/or hardened.

3. The camshaft according to claim 1, wherein, said termination element (2) with its first coupling area (3) embraces the camshaft (1) on the axial end side or rests on and/or supports itself on an inner cylindrical surface (6) of the camshaft (1).

4. The camshaft according to claim 3, wherein, said termination element (2) via its first coupling area (3) is permanently bonded with the camshaft (1), pressed, welded or via a circumferential thread formed on the first coupling area (3), which interacts with a counter thread on the inner cylindrical surface (6) of the camshaft (1), screwed to the camshaft (1).

5. The camshaft according to claim 3, wherein, said second coupling area (4) formed as bearing shell (8) or as slot engages in recesses (10) in camshaft cylindrical surfaces (11) which are open towards the axial end of the camshaft (1).

6. The camshaft according to claim 3, wherein, said second coupling area (4) extends radially outward starting from an outer cylindrical surface of the camshaft (1).

7. The camshaft according to claim 3, wherein, said second coupling area (4) starting from the camshaft axis (7) extends radially outward to the inner cylindrical surface of the camshaft (1) at the longest.

8. The camshaft according to claim 3, wherein, said second coupling area (4) starting from the camshaft axis (7) extends radially outward to beyond an outer cylindrical surface of the camshaft (1).

9. The camshaft according to claim 1, wherein, said termination element (2) tightly seals off the camshaft (1) on the axial end side.

10. The camshaft according to claim 1, wherein, said termination element (2) is designed as an assembly aid.

* * * * *